US007135451B2

(12) United States Patent
Corona, III et al.

(10) Patent No.: US 7,135,451 B2
(45) Date of Patent: Nov. 14, 2006

(54) FABRIC CARE COMPOSITIONS COMPRISING CATIONIC STARCH

(75) Inventors: Alessandro Corona, III, Mason, OH (US); Alice Marie Ward, Middletown, OH (US); Yonas Gizaw, Cincinnati, OH (US); Donald Ray Brown, Middletown, OH (US); Anna Liza Tolentino, Cincinnati, OH (US); Gayle Marie Frankenbach, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 70 days.

(21) Appl. No.: 10/789,841

(22) Filed: Feb. 26, 2004

(65) Prior Publication Data

US 2004/0204337 A1 Oct. 14, 2004

Related U.S. Application Data

(60) Provisional application No. 60/457,448, filed on Mar. 25, 2003.

(51) Int. Cl.
*C11D 3/37* (2006.01)

(52) U.S. Cl. ..... 510/527; 510/522; 510/474

(58) Field of Classification Search ..... 510/474, 510/516, 522, 527
See application file for complete search history.

(56) References Cited

U.S. PATENT DOCUMENTS

| | | | | |
|---|---|---|---|---|
| 3,892,681 | A | 7/1975 | Edwards et al. | |
| 4,162,983 | A | 7/1979 | Johnson | |
| 4,165,290 | A | 8/1979 | Johnson et al. | |
| 4,178,254 | A | 12/1979 | Leikhim et al. | |
| 4,179,382 | A | 12/1979 | Rudkin et al. | |
| 4,789,491 | A | 12/1988 | Chang et al. | |
| 4,818,242 | A | 4/1989 | Burmeister et al. | |
| 4,885,102 | A | 12/1989 | Yamamura et al. | |
| 4,964,915 | A | 10/1990 | Blixt et al. | |
| 5,061,385 | A | 10/1991 | Duffin | |
| 5,085,857 | A | 2/1992 | Reid et al. | |
| RE34,062 | E | 9/1992 | Wells | |
| 5,246,694 | A | 9/1993 | Birthwistle | |
| 5,447,643 | A * | 9/1995 | Kelkenberg et al. | 510/524 |
| 5,460,736 | A | 10/1995 | Trinh et al. | |
| 5,468,398 | A | 11/1995 | Farooq et al. | |
| 5,501,806 | A | 3/1996 | Farooq et al. | |
| 5,545,350 | A | 8/1996 | Baker et al. | |
| 5,612,307 | A | 3/1997 | Chambers et al. | |
| 5,747,443 | A | 5/1998 | Wahl et al. | |
| 5,861,370 | A | 1/1999 | Trinh et al. | |
| 5,916,863 | A | 6/1999 | Iacobucci et al. | |
| 6,444,023 | B1 | 9/2002 | Wilsberg | |
| 6,492,322 | B1 | 12/2002 | Cooper et al. | |
| 6,797,688 | B1 | 9/2004 | Cooper et al. | |
| 2003/0154883 | A1 | 8/2003 | MacKey et al. | |
| 2004/0235707 | A1 | 11/2004 | Cooper et al. | |

FOREIGN PATENT DOCUMENTS

| | | | |
|---|---|---|---|
| BR | 9702031 | A | 12/1998 |
| DE | 44 35 386 | A1 | 4/1996 |
| EP | 0 004 110 | A1 | 9/1979 |
| EP | 0 165 138 | A2 | 12/1985 |
| EP | 0 293 953 | A1 | 12/1988 |
| EP | 0 394 133 | A1 | 10/1990 |
| EP | 432951 | A2 | 6/1991 |
| EP | 0 239 910 | B1 | 10/1992 |
| EP | 0 596 580 | A1 | 5/1994 |
| EP | 0 299 787 | B1 | 3/1995 |
| EP | 0 643 038 | A2 | 3/1995 |
| EP | 0 648 835 | A1 | 4/1995 |
| EP | 0 571 086 | B1 | 4/1997 |
| EP | 0 596 580 | B1 | 4/1997 |
| EP | 0 394 133 | B1 | 8/1997 |
| EP | 0 811 680 | A1 | 12/1997 |
| EP | 0 822 287 | A1 | 2/1998 |
| EP | 0 792 337 | B1 | 2/1999 |
| EP | 0 799 887 | B1 | 6/2003 |
| JP | 8-337971 | | 12/1996 |
| JP | 10-316949 | A | 12/1998 |
| JP | 10-316950 | A | 12/1998 |
| JP | 10-316951 | A | 12/1998 |
| WO | WO 90/12862 | A1 | 11/1990 |
| WO | WO 94/20597 | A1 | 9/1994 |
| WO | WO 95/05442 | A1 | 2/1995 |
| WO | WO 95/05443 | A1 | 2/1995 |
| WO | WO 95/24460 | A1 | 9/1995 |
| WO | WO 96/11248 | A1 | 4/1996 |
| WO | WO 96/29980 | A1 | 10/1996 |
| WO | WO 97/08285 | A1 | 3/1997 |
| WO | WO 97/42289 | A1 | 11/1997 |
| WO | WO 98/16538 | A1 | 4/1998 |
| WO | WO 98/23715 | A1 | 6/1998 |
| WO | WO 99/43777 | A1 | 9/1999 |
| WO | WO 00/75192 | A1 | 12/2000 |

(Continued)

OTHER PUBLICATIONS

Prof. Dr. J. Falbe, Cosmetics and Toiletries Guide Compositions, Surfactants in Consumer Products, 1987, Springer-Verlag Heidleberg, Germany.

(Continued)

*Primary Examiner*—John R. Hardee
(74) *Attorney, Agent, or Firm*—David V. Upite; Jason J. Camp; Kim W. Zerby

(57) ABSTRACT

Fabric care compositions comprise cationic starch and fabric softening active, wherein the composition comprises a viscosity of less than about 2000 centipoise.

14 Claims, No Drawings

FOREIGN PATENT DOCUMENTS

| | | |
|---|---|---|
| WO | WO 01/46361 A1 | 6/2001 |
| WO | WO 01/81524 A1 | 11/2001 |

OTHER PUBLICATIONS

Marvin W. Formo, Eric Jungermann, Frank A. Norris, Norman O. V. Sonntag, Reactions in the Fatty Acid Chain, vol. 1, Fourth Edition, 1979, Reactions of Fat and Fatty Acids,pp. 114-115, (A Wiley-Interscients Publication, US).

Marvin W. Formo, Eric Jungermann, Frank A. Norris, Norman O. V. Sonntag, Reactions in the Fatty Acid Chain, vol. 1, Fourth Edition, 1979, Compositions and Characteristics of Individual Fate and Oila, pp. 342,343, (A Wiley-Interscients Publication, US).

* cited by examiner

FABRIC CARE COMPOSITIONS COMPRISING CATIONIC STARCH

CROSS REFERENCE

This application claims the benefit of U.S. Provisional Application No. 60/457,448, filed Mar. 25, 2003, hereby incorporated herein by reference.

FIELD OF INVENTION

The present invention relates to fabric care compositions comprising cationic starch and process for making same.

BACKGROUND OF THE INVENTION

Fabric care compositions include those fabric softening compositions which are generally used during the rinse cycle or drying cycle of a typical laundry process or as a spray-on product to provide improved softness, static control, wrinkle release and/or freshness to the fabrics being laundered.

Cationic starch has previously been utilized in fabric softening compositions as a thickening agent. For example, EP 596,580 discloses a liquid fabric softening composition containing a biodegradable cationic fabric softener and a fully gelatinized cationic starch. The fully gelatinized cationic starch is added to the composition as a thickening agent to increase the viscosity of the composition. However, these compositions are typically either highly dilute compositions (e.g. containing only 4% fabric softener active) or are concentrated compositions having viscosities (e.g. >2000 mPas) that are undesirable from a consumer use standpoint.

There remains a need to develop an improved fabric care composition that provides improved fabric feel and/or softening, while also limiting viscosity.

SUMMARY OF THE INVENTION

One aspect of the invention provides for a fabric care composition comprising: at least about 10%, by weight of said composition, of fabric softening active; and cationic starch; wherein said composition comprises a viscosity of less than about 2000 centipoise.

Another aspect of the invention provides for a fabric care composition comprising: a fabric softening active; and a cationic starch, wherein said cationic starch comprises starch components having an average molecular weight of from about 50,000 to about 10,000,000.

Another aspect of the invention provides for a fabric care composition comprising: from about 2% to about 90%, by weight of said composition, of a fabric softening active; from about 0.1% to about 5%, by weight of said composition, of a cationic starch; and from about 0.001% to about 10%, by weight of said composition, of an electrolyte.

Another aspect of the invention provides for a method of softening a fabric comprising the step of contacting said fabric with a composition according to any fabric care composition of the present invention.

Another aspect of the invention provides for a fabric care composition comprising a fabric softening active; and a cationic starch; wherein said cationic starch comprises a viscosity measured as Water Fluidity having a value from about 50 to about 84.

Another aspect of the invention provides for a process for making a fabric care composition, said process comprising:

mixing a fabric softening active and a cationic starch to form a premix; and combining said premix with adjunct ingredients to form said fabric softening composition.

Another aspect of the invention provides for a process for making a fabric care composition, said process comprising: forming an aqueous solution comprising cationic starch having a pasting temperature; heating said aqueous solution to a temperature less than said pasting temperature of said cationic starch to form partially gelatinized cationic starch; and adding said partially gelatinized cationic starch to a fabric care composition.

Another aspect of the invention provides for a kit comprising: a composition according to a fabric care composition of the present invention; and instructions for use thereof.

DETAILED DESCRIPTION OF THE INVENTION

Viscosity Of Composition

The compositions of the present invention may comprises a viscosity of less than about 2000 centipoise, preferably less than about 500 centipoise, more preferably less than about 200 centipoise, even more preferably less than about 150, and still even more preferably less than about 120 centipoise. For purposes of the present invention, the viscosities of the present compositions are measured at 25° C. with a Brookfield® viscometer using a No. 2 spindle at 60 rpm. In one embodiment, the composition of the present invention comprises a viscosity from about 5 centipoise to about 500 centipoise.

Cationic Starch

The present compositions comprise cationic starch. The term "cationic starch" is used herein in the broadest sense. In one aspect of the invention, cationic starch refers to starch that has been chemically modified to provide the starch with a net positive charge in aqueous solution at pH 3. This chemical modification includes, but is not limited to, the addition of amino and/or ammonium group(s) into the starch molecules. Non-limiting examples of these ammonium groups may include substituents such as trimethylhydroxypropyl ammonium chloride, dimethylstearylhydroxypropyl ammonium chloride, or dimethyldodecylhydroxypropyl ammonium chloride. See Solarek, D. B., *Cationic Starches in Modified Starches: Properties and Uses*, Wurzburg, O. B., Ed., CRC Press, Inc., Boca Raton, Fla. 1986, pp 113–125.

The compositions of the present invention generally comprise cationic starch at a level of from about 0.1% to about 7%, more preferably 0.1% to about 5%, more preferably from about 0.3% to about 3%, and still more preferably from about 0.5% to about 2.0%, by weight of the composition.

The source of starch before chemical modification can be chosen from a variety of sources incuding tubers, legumes, cereal, and grains. Non-limiting examples of this source starch may include corn starch, wheat starch, rice starch, waxy corn starch, oat starch, cassaya starch, waxy barley, waxy rice starch, glutenous rice starch, sweet rice starch, amioca, potato starch, tapioca starch, oat starch, sago starch, sweet rice, or mixtures thereof.

In one embodiment of the invention, cationic starch for use in the present compositions is chosen from cationic maize starch, cationic tapioca, cationic potato starch, or mixtures thereof. In another embodiment, cationic starch is cationic maize starch.

The cationic starch in the present invention may compromise one or more additional modifications. For example, these modifications may include cross-linking, stabilization reactions, phophorylations, hydrolyzations, cross-linking. Stabilization reactions may include alkylation and esterification.

Cationic starch of the present invention may comprise a maltodextrin. In one embodiment, cationic starch of the present invention may comprise a Dextrose Equivalance ("DE") value of from about 0 to about 35. The Dextrose Equivalence value is a measure of the reducing equivalence of the hydrolyzed starch referenced to dextrose and expressed as a percent (on dry basis). One skilled in the art will readily appreciate that a completely hydrolyzed starch to dextrose has a DE value of 100, while unhydrolyzed starch has a DE of 0. In one embodiment of the invention, the cationic starch of the present invention comprises maltodextrin and comprises a DE value of from about 0 to about 35, preferably of from about 5 to about 35. A suitable assay for DE value includes one described in "Dextrose Equivalent," Standard Analytical Methods of the Member Companies of the Corn Industries Research Foundation. 1Ed., Method E-26. Cationic starch of the present invention may comprise a dextrin. One skilled in the art will readily appreciate that dextrin is typically a pyrolysis product of starch with a wide range of molecular weights.

In one embodiment of the present invention, the cationic starch of the present invention may comprise a particular degree of substitution. As used herein, the "degree of substitution" of cationic starches is an average measure of the number of hydroxyl groups on each anhydroglucose unit which are derivitised by substituent groups. Since each anhydroglucose unit has three potential hydroxyl groups available for substitution, the maximum possible degree of substitution is 3. The degree of substitution is expressed as the number of moles of substituent groups per mole of anhydroglucose unit, on a molar average basis. The degree of substitution can be determined using proton nuclear magnetic resonance spectroscopy ("$^1$H NMR") methods well-known in the art. Suitable $^1$H NMR techniques include those described in "Observation on NMR Spectra of Starches in Dimethyl Sulfoxide, Iodine-Complexing, and Solvating in Water-Dimethyl Sulfoxide", Qin-Ji Peng and Arthur S. Perlin, *Carbohydrate Research,* 160 (1987), 57–72; and "An Approach to the Structural Analysis of Oligosaccharides by NMR Spectroscopy", J. Howard Bradbury and J. Grant Collins, *Carbohydrate Research,* 71, (1979), 15–25. In one embodiment of the invention, the cationic starch comprises a degree of substitution of from about 0.01 to about 2.5, preferably from about 0.01 to about 1.5, and more preferably from about 0.025 to about 0.5. In another embodiment of the invention, when the cationic starch comprises cationic maize starch, said cationic starch preferably comprises a degree of substitution of from about 0.04 to about 0.06. In still another embodiment of the invention, when the cationic starch comprises a hydrolyzed cationic starch, said cationic starch comprises a degree of substitution of from about 0.02 to about 0.06.

One skilled in the art will readily appreciate that starch, particularly native starch, comprises polymers made of glucose units. There are two distinct polymer types. One type of polymer is amylose whereas the other is amylopectin. The cationic starch of the present invention may be further characterized with respect to these types of polymers. In one embodiment, the cationic starch of the present invention comprises amylose at a level of from about 0% to about 70%, preferably from about 10% to about 60%, and more preferably from about 15% to about 50%, by weight of the cationic starch. In another embodiment, when the cationic starch comprises cationic maize starch, said cationic starch preferably comprises from about 25% to about 30% amylose, by weight of the cationic starch. The remaining polymer in the above embodiments essentially comprises amylopectin.

A suitable techniques for measuring percentage amylose by weight of the cationic include the methods described by the following: "Determination of Amylose in Cereal and Non-Cereal Starches by a Colorimetric Assay: Collaborative Study", Christina Martinez and Jaques Prodolliet, Starch, 48 (1996), pp. 81–85; and "An Improved Colorimetric Procedure for Determining Apparent and Total Amylose in Cereal and Other Starches", William R. Morrison and Bernard Laignelet, Journal Of Cereal Science, 1 (1983).

The cationic starches of the present invention may comprise amylose and/or amylopectin (hereinafter "starch components") at a particular molecular weight range. In one embodiment of the invention, the cationic starch comprises starch components, wherein said starch components comprise a molecular weight range at preferably from about 50,000 to about 10,000,000; more preferably from about 150,000 to about 7,000,000, more preferably from about 250,000 to about 4,000,000, and even more preferably from about 400,000 to about 3,000,000. In another embodiment, the molecular weight of said starch component is from about 250,000 to about 2,000,000. As used herein, the term "molecular weight of starch component" refers to the weight average molecular weight. This weight average molecular weight may be measured according to a gel permeation chromatography ("GPC") method described in U.S. Publication No. 2003/0154883 A1, entitled "Non-Thermoplastic Starch Fibers and Starch Composition for Making Same."

In one embodiment of the invention, the cationic starch of the present invention is hydrolyzed to reduce the molecular weight of such starch components. The degree of hydrolysis may be measured by Water Fluidity (WF), which is a measure of the solution viscosity of the gelatinized starch. A suitable method for determining WF is described at columns 8–9 of U.S. Pat. No. 4,499,116. One skilled in the art will readily appreciate that cationic starch that has a relatively high degree of hydrolysis will have low solution viscosity or a high water fluidity value. One embodiment of the invention comprises, a cationic starch comprises a viscosity measured as WF having a value from about 50 to about 84, preferably 65 to about 84, more preferable 70 to about 84. A suitable method of hydrolyzing starch includes one described by U.S. Pat. No. 4,499,116, with specific mention to column 4. In one embodiment, the cationic starch of the present invention comprises a viscosity measured by Water Fluidity having a value from about 50 to about 84.

The cationic starch in present invention may be incorporated into the composition in the form of intact starch granules, partially gelatinized starch, pregelatinized starch, cold water swelling starch, hydrolyzed starch (e.g., acid, enzyme, alkaline degradation), or oxidized starch (e.g., peroxide, peracid, alkaline, or any other oxidizing agent). Fully gelatinized starches may also be used, but at lower levels (e.g., about 0.1% to about 0.8% by weight of the cationic starch)to prevent fabric stiffness and limit viscosity increases. Fully gelatinized starches may be used at the higher levels (e.g., 0.5% to about 5% by weight of the cationic starch) when the molecular weight of the starch material has been reduced by hydrolysis.

Suitable cationic starches for use in the present compositions are commercially-available from Cerestar under the trade name C*BOND® and from National Starch and Chemical Company under the trade name CATO® 2A.

Fabric Softening Active

The present compositions may further comprise a fabric softening active. Typical minimum levels of incorporation of the fabric softening active in the present compositions are at least about 1%, preferably 2%, preferably at least about 5%, more preferably at least about 10%, and even more preferably at least about 12%, by weight of the composition, and the typical maximum levels of incorporation of the fabric softening active in the present compositions are less than about 90%, preferably less than about 40%, more preferably less than about 30% and even more preferably less than about 20%, by weight of the composition.

One aspect of the invention provides for a certain ratio of fabric softening active to cationic starch. In one embodiment, a ratio of fabric softening active:cationic starch comprises from about 500:1 to about 2:1, preferably from about 50:1 to about 4:1, more preferably from about 40:1 to about 5:1, and even more preferably from about 30:1 to about 6:1. In another embodiment, a ratio of fabric softening active: cationic starch comprises from about 500:1 to about 2:1, preferably from about 50:1 to about 2.5:1, more preferably from about 40:1 to about 3:1, and even more preferably from about 30:1 to about 4:1.

Diester Quaternary Ammonium (DEQA) Compounds

In one embodiment, the fabric softening active comprises a DEQA compound. The DEQA compounds encompass a description of diamido fabrics softener actives as well as fabric softener actives with mixed amido and ester linkages.

A first type of DEQA ("DEQA (1)") suitable as a fabric softening active in the present compositions includes compounds of the formula:

$$\{R_{4-m}—N^+—[(CH_2)_n—Y—R^1]_m\}X^-$$

wherein each R substituent is either hydrogen, a short chain $C_1$–$C_6$, preferably $C_1$–$C_3$ alkyl or hydroxyalkyl group, e.g., methyl (most preferred), ethyl, propyl, hydroxyethyl, and the like, poly ($C_{2-3}$ alkoxy), preferably polyethoxy, group, benzyl, or mixtures thereof; each m is 2 or 3; each n is from 1 to about 4, preferably 2; each Y is —O—(O)C—, —C(O)—O—, —NR—C(O)—, or —C (O)—NR—and it is acceptable for each Y to be the same or different; the sum of carbons in each $R^1$, plus one when Y is —O—(O)C— or —NR—C(O)—, is $C_{12}$–$C_{22}$, preferably $C_{14}$–$C_{20}$, with each $R^1$ being hydrocarbyl, or substituted hydrocarbyl group; it is acceptable for $R^1$ to be unsaturated or saturated and branched or linear and preferably it is linear; it is acceptable for each $R^1$ to be the same or different and preferably these are the same; and $X^-$ can be any softener-compatible anion, preferably, chloride, bromide, methylsulfate, ethylsulfate, sulfate, phosphate, and nitrate, more preferably chloride or methyl sulfate. Preferred DEQA compounds are typically made by reacting alkanolamines such as MDEA (methyldiethanolamine) and TEA (triethanolamine) with fatty acids. Some materials that typically result from such reactions include N,N-di(acyl-oxyethyl)-N,N-dimethylammonium chloride or N,N-di(acyl-oxyethyl)-N,N-methylhydroxyethylammonium methylsulfate wherein the acyl group is derived from animal fats, unsaturated, and polyunsaturated, fatty acids, e.g., oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, etc. Non-limiting examples of suitable fatty acids are listed in U.S. Pat. No. 5,759,990 at column 4, lines 45–66. Those skilled in the art will recognize that active softener materials made from such process can comprise a combination of mono-, di-, and tri-esters depending on the process and the starting materials. Materials from this group preferred for the present invention include those comprising a high level of diester content; more than 40%, preferably more than 55%, preferably more than 60%, still more preferably than 70%, and yet still more preferably at least about 80% of the total softener active weight (as used herein, the total softener active weight includes the mass encompassing all reaction products that comprise one or more $R^1$ groups, the percent softener active as used herein to quantify the individual percentages of mono-, di-, and tri-tail reaction products refers to the ratio of an individual portion (mass) of the total softener active wherein the constituents contain a common number of $R^1$ groups divided by the total softener active weight and multiplied by 100 to give a percentage of the total.) In one embodiment, the diester content comprises from about 55% to about 95% of the total percent of softener active weight. Materials from this group preferred for the present invention also include those comprising a low level of monoester content; preferably less than about 30%, more preferably less than about 25%, and yet more preferably less than about 20% monoester of the total percent of softener active weight. In another embodiment, the monoester content comprises more than about 1%, preferably more than about 5%, more preferably than about 10% of the total percent of softener active weight. Non-limiting examples of preferred diester quats for the present invention include N,N-di(tallowoyloxyethyl)-N,N-dimethylammonium chloride (available from Akzo under the trade name Armosoft® DEQ) and N,N-di(canola-oyloxyethyl)-N,N-dimethylammonium chloride (available from Degussa under the trade name Adogen® CDMC). Nonlimiting examples of available TEA ester quats suitable for the present invention include di-(hydrogenated tallowoyloxyethyl)-N,N-methylhydroxyethylammonium methylsulfate and di-(oleoyloxyethyl)-N,N-methylhydroxyethylammonium methylsulfate sold under the trade names Rewoquat® WE 15 and Varisoft® WE 16, both available from Degussa.

Additional preferred DEQA (1) actives include compounds comprising different Y structures such as the those having the structure below where one Y═C(O)—O— and the other Y═—NH—C(O)—:

$$R^1—C(O)O—R^2—N^+(R^4)_n—R^3—N(H)—C(O)—R^1X^-$$

wherein n is 1 or 2; $R^1$ is a $C_6$–$C_{22}$, preferably a $C_8$–$C_{20}$, hydrocarbyl group or substituted hardrocarbyl groups that are branched or unbranched and saturated or unsaturated; $R^2$ and $R^3$ are each $C_1$–$C_5$, preferably $C_2$–$C_3$, alkyl or alkylene groups; and $R^4$ is H, or a $C_1$–$C_3$ alkyl or hydroxyalkyl group. A non-limiting example of such softener is N-tallowoyloxyethyl-N-tallowoylaminopropyl methyl amine. Additional non-limiting examples of such softeners are described in U.S. Pat. No. 5,580,481 and U.S. Pat. No. 5,476,597.

Other suitable fabric softening actives include reaction products of fatty acids with dialkylenetriamines in, e.g., a molecular ratio of about 2:1, said reaction products containing compounds of the formula:

$$R^1—C(O)—NH—R^2—NH—R^3—NH—C(O)—R^1$$

wherein $R^1$, $R^2$ are defined as above, and each $R^3$ is a $C_{1-6}$ alkylene group, preferably an ethylene group. Examples of these fabric softening actives are reaction products of tallow acid, canola acid, or oleic acids with diethylenetriamine in a molecular ratio of about 2:1, said reaction product mixture containing N,N"-ditallowoyldiethylenetriamine, N,N"-dicanola-oyldiethylenetriamine, or N,N"-dioleoyldiethylenetriamine, respectively, with the formula:

$$R^1—C(O)—NH—CH_2CH_2—NH—CH_2CH_2—NH—C(O)—R^1$$

wherein $R^2$ and $R^3$ are divalent ethylene groups, $R^1$ is defined above and an acceptable examples of this structure when $R^1$ is the oleoyl group of a commercially available oleic acid derived from a vegetable or animal source, include Emersol® 223LL or Emersol® 7021, available from Henkel Corporation.

Another fabric softening active for use in the present compositions has the formula:

$$[R^1—C(O)—NR—R^2—N(R)_2—R^3—NR—(O)—R^1]^+X^-$$

wherein R, $R^1$, $R^2$, $R^3$ and $X^-$ are defined as above. Examples of this fabric softening active are the di-fatty amidoamines based softener having the formula:

$$[R^1—C(O)—NH—CH_2CH_2—N(CH_3)(CH_2CH_2OH)—CH_2CH_2—NH—C(O)—R^1]^+ CH_3SO_4^-$$

wherein $R^1$—C(O) is an oleoyl group, soft tallow group, or a hardened tallow group available commercially from Degussa under the trade names Varisoft® 222LT, Varisoft® 222, and Varisoft® 110, respectively.

A second type of DEQA ("DEQA (2)") compound suitable as a fabric softening active in the present compositions has the general formula:

$$[R_3N^+CH_2CH(YR^1)(CH_2YR^1)]X^{31}$$

wherein each Y, R, $R^1$, and $X^-$ have the same meanings as before. Such compounds include those having the formula:

$$[CH_3]_3\ N(^+)[CH_2CH(CH_2O(O)CR^1)O(O)CR^1]Cl(^-)$$

wherein each R is a methyl or ethyl group and preferably each $R^1$ is in the range of $C_{15}$ to $C_{19}$. As used herein, when the diester is specified, it can include the monoester that is present. The amount of monoester that can be present is the same as in DEQA (1).

These types of agents and general methods of making them are disclosed in U.S. Pat. No. 4,137,180, Naik et al., issued Jan. 30, 1979. An example of a preferred DEQA (2) is the "propyl" ester quaternary ammonium fabric softener active having the formula 1,2-di(acyloxy)-3-trimethylammoniopropane chloride.

While it is acceptable to use fabric softening compounds with any transition temperature; preferably, for the present invention, the fabric softening compound has a transition temperature of equal to or less than about 50° C. It is acceptable for fabric softening compounds to be made with fatty acid precursors with a range of Iodine Values (herein referred to as IV) from about zero to about 140. One aspect of the invention provides for, but is not limited to, performance characteristics that includes fabric softening composition and/or static performance based upon IV ranges. For example, in one embodiment the compositions of the present invention comprises an IV range of from at least about 40 to about 140; alternatively from at least about 35 to about 65, preferably from about 40 to about 60; alternatively from at least about 5 to about 60, preferably from about 15 to about 30, more preferably from about 15 to about 25.

Fabric softening compositions of the present invention that are clear preferably contain highly fluid fabric softening actives with transition temperatures less than about 35° C. These materials can be made with fatty acid precursors having high IV (greater than about 50) or comprising branching or other structural modifications leading to a low transition temperature. Additionally when unsaturated fabric softener actives are used for clear compositions the unsaturated moiety preferably has a cis:trans isomer ratio of at least 1:1, preferably about 2:1, more preferably about 3:1, and even more preferably 4:1 or higher. Some preferred actives for clear compositions are disclosed in U.S. Pat. No. 6,369,025; U.S. application Ser. No. 09/554,969, filed Nov. 24, 1998 by Frankenbach et al. (WO 99/27050); and U.S. Pat. No. 6,486,121.

While it is acceptable for the present invention for the composition to contain a number of softening actives, including other fabric softening actives disclosed herein below, the DEQA fabric softening actives, and specifically those fabric softener actives with two ester linkages, are preferred fabric softening actives for the present invention.

Other Fabric Softening Actives

Instead of, or in addition to, the DEQA fabric softening actives described hereinbefore, the present compositions can also comprise a variety of other fabric softening actives. These other suitable fabric softening actives include:

(1) compounds having the formula:

$$[R_{4-m}—N(^+)—R^1\ m]A^-$$

wherein each m is 2 or 3, each $R^1$ is a $C_6$–$C_{22}$, preferably $C_{14}$–$C_{20}$, but no more than one bein less than about $C_{12}$ and then the other is at least about 16, hydrocarbyl, or substituted hydrocarbyl substituent, preferably $C_{10}$–$C_{20}$ alkyl or alkenyl (unsaturated alkyl, including polyunsaturated alkyl, also referred to sometimes as "alkylene"), most preferably $C_{12}$–$C_{18}$ alkyl or alkenyl, and branch or unbranced. While it is acceptable for the IV of the parent fatty acid containing the $R^1$ group to range from zero to about 140, it is preferred for the present invention to have an IV of at least about 40. When the fabric softener composition will be clear, it is preferred for fabric softner active to be highly fluid by incorporating branching in the hydrocarbyl group by incorporating high unsaturation e.g. the IV of a fatty acid containing this $R^1$ group is from about 70 to about 140, more preferably from about 80 to about 130; and most preferably from about 90 to about 115 (as used herein, the term "Iodine Value" means the Iodine Value of a "parent" fatty acid, or "corresponding" fatty acid, which is used to define a level of unsaturation for an $R^1$ group that is the same as the level of unsaturation that would be present in a fatty acid containing the same $R^1$ group) with, preferably, a cis/trans ratio as specified above for highly unsaturated compounds; each R is H or a short chain $C_1$–$C_6$, preferably $C_1$–$C_3$ alkyl or hydroxyalkyl group, e.g., methyl (most preferred), ethyl, propyl, hydroxyethyl, and the like, benzyl, or $(R^2\ O)_{2-4}H$ where each $R^2$ is a $C_{1-6}$ alkylene group; and $A^-$ is a softener compatible anion, preferably, chloride, bromide, methylsulfate, ethylsulfate, sulfate, phosphate, or nitrate; more preferably chloride or methyl sulfate. Examples of these fabric softening actives include dialkydimethylammonium salts and dialkylenedimethylammonium salts such as ditallowdimethylammonium chloride, dicanoladimethylammonium chloride, and dicanoladimethylammonium methylsulfate. Examples of commercially available dialkylenedimethylammonium salts usable in the present invention are di-hydrogenated tallow dimethyl ammonium chloride, ditallowdimethyl ammonium chloride, and dioleyldimethylammonium chloride available from Degussa under the trade names Adogen® 442, Adogen® 470, and Adogen® 472, respectively.

(2)compounds having the formula:

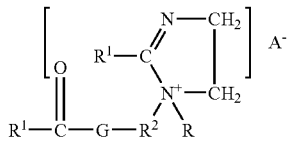

wherein each R, $R^1$, and $A^-$ have the definitions given above; each $R^2$ is a $C_{1-6}$ alkylene group, preferably an ethylene group; and G is an oxygen atom or an —NR— group. Examples of this fabric softening active are 1-methyl-1-tallowylamidoethyl-2-oleylimidazolinium methylsulfate and 1-methyl-1-oleylamidoethyl-2-oleylimidazolinium methylsulfate wherein $R^1$ is an acyclic aliphatic $C_{15}$–$C_{17}$ hydrocarbon group, $R^2$ is an ethylene group, G is a NH group, $R^5$ is a methyl group and $A^-$ is a methyl sulfate anion, available commercially from Degussa under the trade names Varisoft® 475 and Varisoft® 3690, respectively.

(3) compounds having the formula:

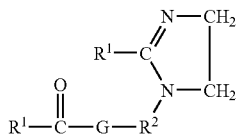

wherein $R^1$, $R^2$ and G are defined as above. An example of this fabric softening active is 1-oleylamidoethyl-2-oleylimidazoline wherein $R^1$ is an acyclic aliphatic $C_{15}$–$C_{17}$ hydrocarbon group, $R^2$ is an ethylene group, and G is a NH group.

(4) reaction products of substantially unsaturated and/or branched chain higher fatty acid with hydroxyalkylalkylenediamines in a molecular ratio of about 2:1, said reaction products containing compounds of the formula:

$$R^1—C(O)—NH—R^2—N(R^3OH)—C(O)—R^1$$

wherein $R^1$, $R^2$ and $R^3$ are defined as above. Examples of this fabric softening active are reaction products of fatty acids such as tallow fatty acid, oleic fatty acid, or canola fatty acid with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is oleoyl, tallowyl, or canola-oyl group of a commercially available fatty acid derived from a vegetable or animal source. Nonlimiting examples of such actives include Emersol® 223LL or Emersol® 7021, which are derived from oleic acid and available from Henkel Corporation.

(5) compounds having the formula:

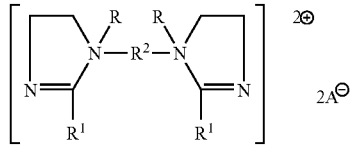

wherein R, $R^1$, $R^2$, and $A^-$ are defined as above.

Other compounds suitable as fabric softening actives herein are acyclic quaternary ammonium salts having the formula:

$$[R^1—N(R^5)_2—R^6]^+A^-$$

wherein $R^5$ and $R^6$ are $C_1$–$C_4$ alkyl or hydroxyalkyl groups, and $R^1$ and $A^-$ are defined as herein above. Examples of these fabric softening actives are the monoalkyltrimethylammonium salts and the monoalkenyltrimethylammonium salts such as monotallowyltrimethylammonium chloride, monostearyltrimethylammonium chloride, monooleyltrimethylammonium chloride, and monocanolatrimethylammonium chloride. Commercial examples include tallowtrimetylammonium chloride and soyatrimethylammonium chloride available from Degussa under the trade names Adogen® 471 and Adogen® 415.

(6) substituted imidazolinium salts having the formula:

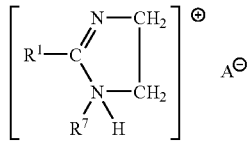

wherein $R^7$ is hydrogen or a $C_1$–$C_4$ saturated alkyl or hydroxyalkyl group, and $R^1$ and $A^-$ are defined as hereinabove;

(7) substituted imidazolinium salts having the formula:

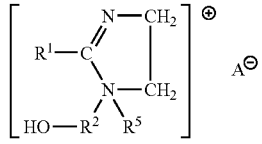

wherein $R^5$ is a $C_1$–$C_4$ alkyl or hydroxyalkyl group, and $R^1$, $R^2$, and $A^-$are as defined above;

(8) alkylpyridinium salts having the formula:

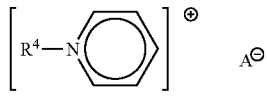

wherein $R^4$ is an acyclic aliphatic $C_8$–$C_{22}$ hydrocarbon group and $A^-$ is an anion. An example of this fabric softening active is 1-ethyl-1-(2-hydroxyethyl)-2-isoheptadecylimidazolinium ethylsulfate wherein $R^1$ is a $C_{17}$ hydrocarbon group, $R^2$ is an ethylene group, $R^5$ is an ethyl group, and $A^{31}$ is an ethylsulfate anion.

(9) alkanamide alkylene pyridinium salts having the formula:

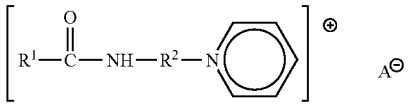

wherein $R^1$, $R^2$ and $A^-$ are defined as herein above; and mixtures thereof.

Other suitable fabric softening actives for use in the present compositions include pentaerythritol compounds. Such compounds are disclosed in more detail in, e.g., U.S. Pat. No. 6,492,322 U.S. Pat. No. 6,194,374; U.S. Pat. No. 5,358,647; U.S. Pat. No. 5,332,513; U.S. Pat. No. 5,290,459; U.S. Pat. No. 5,750,990U.S. Pat. No. 5,830,845 U.S. Pat. No. 5,460,736 and U.S. Pat. No. 5,126,060.

Polyquaternary ammonium compounds can also be useful as fabric softening actives in the present compositions and are described in more detail in the following patent documents: EP 803,498; GB 808,265; GB 1,161,552; DE 4,203,489; EP 221,855; EP 503,155; EP 507,003; EP 803,498; FR 2,523,606; JP 84-273918; JP 2-011,545; U.S. Pat. No. 3,079,436; U.S. Pat. No. 4,418,05; U.S. Pat. No. 4,721,512; U.S. Pat. No. 4,728,337; U.S. Pat. No. 4,906,413; U.S. Pat. No. 5,194,667; U.S. Pat. No. 5,235,082; U.S. Pat. No. 5,670,472; Weirong Miao, Wei Hou, Lie Chen, and Zongshi Li, *Studies on Multifunctional Finishing Agents*, Riyong Huaxue Gonye, No. 2, pp. 8–10, 1992; Yokagaku, Vol. 41, No. 4 (1992); and Disinfection, Sterilization, and Preservation, 4$^{th}$ Edition, published 1991 by Lea & Febiger, Chapter 13, pp. 226–30. The products formed by quaternization of reaction products of fatty acid with N,N,N',N', tetraakis(hydroxyethyl)-1,6-diaminohexane are also suitable for use in the present invention.

Examples of ester and/or amide linked fabric softening actives useful in the present invention, especially for concentrated clear compositions, are disclosed in U.S. Pat. No. 5,759,990 and U.S. Pat. No. 5,747,443. Other fabric softening actives for clear liquid fabric softening compositions are described in U.S. Pat. No. 6,323,172.

Examples of suitable amine softeners that can be used in the present invention as fabric softening actives are disclosed in copending U.S. application Ser. No. 09/463,103, filed Jul. 29, 1997, by Grimm et al., now allowed.

Other fabric softening actives that can be used herein are disclosed, at least generically for the basic structures, in U.S. Pat. No. 3,861,870; U.S. Pat. No. 4,308,151; U.S. Pat. No. 3,886,075; U.S. Pat. No. 4,233,164; U.S. Pat. No. 4,401,578; U.S. Pat. No. 3,974,076; and U.S. Pat. No. 4,237,016. Examples of more biodegradable fabric softeners can be found in U.S. Pat. No. 3,408,361; U.S. Pat. No. 4,709,045; U.S. Pat. No. 4,233,451; U.S. Pat. No. 4,127,489; U.S. Pat. No. 3,689,424; U.S. Pat. No. 4,128,485; U.S Pat. No. 4,161,604; U.S. Pat. No. 4,189,593; and U.S. Pat. No. 4,339,391.

The fabric softening active in the present compositions is preferably selected from the group consisting of ditallowoyloxyethyl dimethyl ammonium chloride, dihydrogenated-tallowoyloxyethyl dimethyl ammonium chloride, dicanola-oyloxyethyl dimethyl ammonium chloride, ditallow dimethyl ammonium chloride, tritallow methyl ammonium chloride, methyl bis(tallow amidoethyl)-2-hydroxyethyl ammonium methyl sulfate, methyl bis(hydrogenated tallow amidoethyl)-2-hydroxyethyl ammonim methyl sulfate, methyl bis (oleyl amidoethyl)-2-hydroxyethyl ammonium methyl sulfate, ditallowoyloxyethyl dimethyl ammonium methyl sulfate, dihydrogenated-tallowoyloxyethyl dimethyl ammonium chloride, dicanola-oyloxyethyl dimethyl ammonium chloride, N-tallowoyloxyethyl-N-tallowoylaminopropyl methyl amine, 1,2-bis(hardened tallowoyloxy)-3-trimethylammonium propane chloride, and mixtures thereof.

It will be understood that all combinations of fabric softening actives disclosed above are suitable for use in this invention.

Electrolyte

Electrolyte is an optional, but preferred, additive for compositions of the present invention. Electrolyte is especially preferred in compositions comprising at least 10% fabric softening active, by weight. Electrolyte is preferably included in dispersion compositions of the present invention to achieve preferred viscosity of equal to or less than about 2000 centipoise, preferably less than about 200 centipoise. Electrolyte is preferably included in clear compositions to modify the viscosity/elasticity profile of the composition on dilution and to provide lower viscosity and/or elasticity to the composition itself. Additionally, for clear compositions, the electrolyte is a highly preferred additive enabling the use of lower solvent levels to achieve an economically feasible clear composition, while still maintaining a preferred viscosity of equal to or less than about 200 centipoise for the composition as well as providing preferred lower viscosity upon dilution.

Suitable electrolytes for incorporation in the present compositions include inorganic salts. Non-limiting examples of suitable inorganic salts include: $MgI_2$, $MgBr_2$, $MgCl_2$, $Mg(NO_3)_2$, $Mg_3(PO_4)_2$, $Mg_2P_2O_7$, $MgSO_4$, magnesium silicate, NaI, NaBr, NaCl, NaF, $Na_3(PO_4)$, $NaSO_3$, $Na_2SO_4$, $Na_2SO_3$, $NaNO_3$, $NaIO_3$, $Na_3(PO_4)$, $Na_4P_2O_7$, sodium silicate, sodium metasilicate sodium tetrachloroaluminate, sodium tripolyphosphate (STPP), $Na_2Si_3O_7$, sodium zirconate, $CaF_2$, $CaCl_2$, $CaBr_2$, $CaI_2$, $CaSO_4$, $Ca(NO_3)_2$, Ca, KI, KBr, KCl, KF, $KNO_3$, $KIO_3$, $K_2SO_4$, $K_2SO_3$, $K_3(PO_4)$, $K_4(P_2O_7)$, potassium pyrosulfate, potassium pyrosulfite, LiI, LiBr, LiCl, LiF, $LiNO_3$, $AlF_3$, $AlCl_3$, $AlBr_3$, $AlBr_3$, $AlI_3Al_2(SO_4)_3$, $AI(PO_4)$, $Al(NO_3)_3$, aluminum silicate ; including hydrates of these salts and including combinations of these salts or salts with mixed cations e.g. potassium alum $AIK(SO_4)_2$ and salts with mixed anions, e.g. potassium tetrachloroaluminate and sodium tetrafluoroaluminate. Salts incorporating cations from groups IIIa, IVa, Va, VIa, VIIa, VIII, Ib, and IIb on the periodic chart with atomic numbers >13 are also useful in reducing dilution viscosity but less preferred due to their tendency to change oxidation states and thus they can adversely affect the odor or color of the formulation or lower weight efficiency. Salts with cations from group Ia or IIa with atomic numbers >20 as well as salts with cations from the lactinide or actinide series are useful in reducing dilution viscosity, but less preferred. Mixtures of above salts are also useful.

Other suitable electrolytes for incorporation in the present compositions include organic salts. Non-limiting examples of suitable organic salts include, magnesium, sodium, lithium, potassium, zinc, and aluminum salts of the carboxylic acids including formate, acetate, proprionate, pelargonate, citrate, gluconate, lactate aromatic acids e.g. benzoates, phenolate and substituted benzoates or phenolates, such as phenolate, salicylate, polyaromatic acids terephthalates, and polyacids e.g. oxylate, adipate, succinate, benzenedicarboxylate, benzenetricarboxylate. Other useful organic salts include carbonate and/or hydrogencarbonate ($HCO_3^{-1}$) when the pH is suitable, alkyl and aromatic sulfates and sulfonates e.g. sodium methyl sulfate, benzene sulfonates and derivatives such as xylene sulfonate, and amino acids when the pH is suitable. Electrolytes can comprise mixed salts of the above, salts neutralized with mixed cations such as potassium/sodium tartrate, partially neutralized salts such as sodium hydrogen tartrate or potassium hydrogen phthalate, and salts comprising one cation with mixed anions.

Generally, inorganic electrolytes are preferred over organic electrolytes for better weight efficiency and lower costs. Mixtures of inorganic and organic salts can be used. Typical levels of electrolyte in the compositions of the present invention are from about 0.001% to about 10%, by weight of the composition. Preferred levels of electrolyte for dispersion compositions are typically from about 0.001% to about 3%, preferably from about 0.01% to about 2%, and more preferably from about 0.05% to about 1%. Preferred levels of electrolyte for clear compositions are from about 0.5% to about 5%, preferably from about 0.75% to about 2.5%, and more preferably from about 1% to about 2%, by weight of the composition.

Phase Stabilizing Polymers

Optionally, the compositions herein further comprise from 0% to about 10%, preferably from about 0.1% to about 5%, more preferably from about 0.1% to about 2%, of a phase stabilizing polymer. Preferred phase stabilizing polymers comprising cationic functionalities are disclosed in U.S. Pat. No. 4,956,447.

A preferred phase stabilizing polymer may be a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this phase stabilizing polymer is in the range of from about 5,000 to about 55,000.

Another preferred phase stabilizing polymer may be a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials ZELCON® 4780 (from DuPont) and MILEASE® T (from ICI).

Highly preferred phase stabilizing polymers are described in more detail in U.S. Pat. No. 5,574,179 at col. 14, line 66 to col. 15, line 67; in U.S. Pat. No. 4,861,512; and in U.S. Pat. No. 4,702,857.

Aqueous Carrier

The present compositions will generally comprise an aqueous carrier comprising water. The level of aqueous carrier generally constitutes the balance of the present compositions.

Adjunct Ingredients

The present compositions optionally, but preferably, comprise additional adjunct ingredients, preferably selected from the group consisting of perfume, nonionic surfactant, non-aqueous solvent, fatty acid, dye, preservatives, optical brighteners, antifoam agents, and mixtures thereof. The amount of each optional adjunct ingredient is typically up to about 2.0%, by weight of the composition, unless otherwise specified.

The present compositions preferably further comprise perfume. Perfume is typical incorporated in the present compositions at a level of at least about 0.001%, preferably at least about 0.01%, more preferably at least about 0.1%, and no greater than about 10%, preferably no greater than about 5%, more preferably no greater than about 3%, by weight of the composition.

The present compositions can optionally further comprise a nonionic surfactant. The nonionic surfactant is preferably an alkoxylated nonionic surfactant, especially an ethoxylated nonionic surfactant. Suitable nonionic surfactants further include nonionic surfactants derived from saturated and/or unsaturated primary, secondary, and/or branched, amine, amide, amine-oxide fatty alcohol, fatty acid, alkyl phenol, and/or alkyl aryl carboxylic acid compounds, each preferably having from about 6 to about 22, more preferably from about 8 to about 18, carbon atoms in a hydrophobic chain, more preferably an alkyl or alkylene chain, wherein at least one active hydrogen of said compounds is ethoxylated with $\leqq 50$, preferably $<30$, more preferably from about 5 to about 15, and even more preferably from about 8 to about 12, ethylene oxide moieties to provide an HLB of from about 8 to about 20, preferably from about 10 to about 18, and more preferably from about 11 to about 15. Suitable nonionic surfactants are described in more detail in U.S. Pat. No. 6,514,931 at col. 8, lines 1–24; U.S. Pat. No. 6,492,322; and U.S. application Ser. No. 09/554,969, filed Nov. 24, 1998 by Frankenbach et al. (WO 99/27050). When present, nonionic surfactants are typically present in the compositions at a level of from about 0.01% to about 5%, preferably from about 0.05% to about 3%, and more preferably from about 0.1% to about 2%, by weight of the composition. Suitable nonionic surfactants include those commercially-available from Shell Chemicals under the trade name NEODOL® 91-8 and from BASF under the trade name PLURONIC® L35.

The present compositions can optionally further comprise solvents. Suitable solvents can be water-soluble or water-insoluble and can include ethanol, propanol, isopropanol, n-butanol, t-butanol, propylene glycol, ethylene glycol, dipropylene glycol, propylene carbonate, butyl carbitol, phenylethyl alcohol, 2-methyl 1,3-propanediol, hexylene glycol, glycerol, polyethylene glycol, 1,2-hexanediol, 1,2-pentanediol, 1,2-butanediol, 1,4-cyclohexanediol, pinacol, 1,5-hexanediol, 1,6-hexanediol, 2,4-dimethyl-2,4-pentanediol, 2,2,4-trimethyl-1,3-pentanediol, 2-ethyl-1,3-hexanediol, phenoxyethanol, or mixtures thereof. Solvents are typically incorporated in the present compositions at a level of less than about 40%, preferably from about 0.5% to about 25%, more preferably from about 1% to about 10%, by weight of the composition. Preferred solvents, especially for clear compositions herein, have a ClogP of from about −2.0 to about 2.6, preferably from about −1.7 to about 1.6, and more preferably from about −1.0 to about 1.0, which are described in detail in U.S. application Ser. No. 09/554,969, filed Nov. 24, 1998 by Frankenbach et al. (WO 99/27050).

The present compositions can optionally further comprise fatty acid. Suitable fatty acids include those containing from about 12 to about 25, preferably from about 13 to about 22, more preferably from about 16 to about 20, total carbon atoms, with the fatty moiety containing from about 10 to about 22, preferably from about 10 to about 18, more preferably from about 10 to about 14 (mid cut), carbon atoms. The shorter moiety contains from about 1 to about 4, preferably from about 1 to about 2 carbon atoms. See e.g., EP 839,899.

While the present compositions can further comprise additional optional components such as oily sugar derivatives, such as those disclosed in WO 01/46361 and U.S. Pat. No. 6,514,931, the compositions are preferably free of these oily sugar derivatives. The present compositions can also further comprise optional anionic surfactants. However, if anionic surfactants are present, they are preferably included at a level of less than about 5%, preferably from about 0.1% to about 1%, by weight of the composition. The present compositions can also be free of anionic surfactants.

The present compositions can be liquid or solid, and are preferably liquid compositions. Liquid compositions of the present invention can be clear or opaque (dispersions). As used herein, "clear composition" refers to compositions that are clear in the absence of cationic starch being in the composition. Solid compositions of the present invention can be incorporated onto a substrate material, preferably a nonwoven substrate material, for use in treating fabrics in a laundry dryer. Suitable substrate materials are described in U.S. Pat. No. 5,929,026; U.S. Pat. No. 5,883,069; and U.S. Pat. No. 5,470,492. The present compositions can also be provided in a unit dose form, for example, as a liquid composition contained in a water-soluble film (e.g. polyvinyl alcohol film) or as a solid tablet unit dose form. Spray-on compositions may also be suitable.

The present compositions will generally have a pH of from about 2 to about 5, preferably from about 2 to about 4.5, and more preferably from about 2.5 to about 4.

Process of Manufacture

The compositions of the present invention can be manufactured by mixing together the various components of the compositions described herein. A preferred process for manufacturing the present compositions comprises the steps of: mixing a fabric softening active and a cationic starch to form a premix and combining said premix with additional ingredients to form a fabric care composition. Another preferred process for manufacturing the present compositions comprises the steps of: mixing a fabric softening active and a cationic starch in water, then mixing with additional ingredients to form a fabric care composition.

The cationic starches of the present invention can be added to the present compositions as part of the making process or can be prepared as a separate solution and admixed with the present compositions. When added to the present composition during the making process, the cationic starch (e.g. as a dry powder) can be admixed with the fabric softening active and then dispersed into water, or the starch can be added to the water to form a separate solution, with subsequent dispersion of the fabric softening active into the water-starch solution. Then additional fabric care composition ingredients are added to this premix of cationic starch and fabric softening active.

When preparing as a separate solution, the dry starch powder is added to about 25° C. temperature water and then heated to "cook" or gelatinize the starch. This gelatinization process is well known phenomena in the literature. One reference for this procedure is from Cereal Foods World, (33) 306, 1988. Gelatinization is the collapse (disruption) of molecular orders within starch granules manifested in irreversible changes in properties such as granule swelling, native crystallite melting, loss of birefringence, and leaching of soluble components (primarily amylose). Some amylose leach can occur at temperatures below the gelatinization temperature.

The temperature of initial gelatinization and the range over which gelatinization occurs depends on the method used to determine it and is governed by the starch concentration, method of observation, granule type, and heterogeneities within the granule population under observation.

Starch pasting is the phenomenon following gelatinization when a starch slurry containing excess water is heated. It involves further granule swelling, additional leaching of soluble components, and total disruption of granules, resulting in molecules and aggregates of molecules in dispersion or solution.

The cationic starch of the present invention can be partially gelatinized or fully gelatinized as a separate aqueous solution and then admixed with a separately prepared fabric care composition. In one embodiment, partially gelatinized starch is admixed with the fabric care composition in order to achieve the desired fabric properties when used in a laundry washing process. "Partially gelatinized" cationic starch is achieved by heating the dry starch granules in an excess of water to a temperature equal to or less than the pasting temperature characteristic for that starch. The pasting temperature provides an indication of the minimum temperature required to cook a given sample, as at the pasting temperature, the starch granules begin to swell and viscosity increases on shearing as swollen granules have to squeeze past each other. Pasting temperature can be readily measured using Rapid Visco-Analysis ("RVA") where the pasting temperature is that at which the viscosity curve produced leaves the baseline as the temperature rises during the initial heating process. This analysis, including a discussion of "pasting temperature", is described in further detail in Application for Rapid Visco Analyses, November. 1998, Newport Scientific Pty., Ltd., pp. 13–18.

"Fully gelatinized" cationic starches are those that are cooked past the pasting temperature, causing granule rupture and subsequent polymer realignment. This phenomenon is observed as a reduction in viscosity during the RVA. In another embodiment, the compositions of the present invention comprise fully gelatinized cationic starch.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and claims, are by weight and all numerical limits are used with the normal degree of accuracy afforded by the art, unless otherwise specified.

The following are non-limiting examples of the fabric care compositions of the present invention.

| INGREDIENTS | EXAMPLE I | II | III | IV | V | VI | VII | VIII | IX |
|---|---|---|---|---|---|---|---|---|---|
| Fabric Softening Active[a] | 14.00% | 14.00% | 14.00% | 18.51% | 4.67% | — | — | 2.50% | 2.00% |
| Fabric Softening Active[b] | — | — | — | — | — | 18.00% | 15.00% | — | — |
| Fabric Softening Active[c] | — | — | — | — | — | 3.00% | — | — | — |
| Ethanol | 2.28% | 2.28% | 2.28% | 2.91% | 0.76% | 2.45% | 2.04% | 0.41% | 0.33% |
| Isopropyl Alcohol | — | — | — | — | — | 0.33% | — | — | — |
| Cationic Starch[d] | 1.00% | 2.00% | 3.00% | 1.68% | 0.67% | 1.68% | 2.00% | 0.35% | 0.70% |
| Perfume | 1.58% | 1.58% | 1.58% | 1.28% | 0.50% | 1.30% | 2.00% | 0.03% | 0.03% |
| TMPD[e] | — | — | — | — | — | 5.00% | 4.50% | — | — |
| NEODOL ® 91–8 | — | — | — | — | — | 2.15% | 2.75% | — | — |
| PLURONIC ® L35 | — | — | — | — | — | 1.50% | 1.27% | — | — |
| Phase Stabilizing Polymer[f] | 0.25% | 0.25% | 0.25% | 0.25% | — | — | — | — | — |
| Calcium Chloride | 0.250% | 0.300% | 0.350% | 0.545% | — | — | — | — | — |
| Magnesium Chloride | — | — | — | — | — | 2.00% | 2.00% | — | — |
| DTPA[g] | 0.005% | 0.005% | 0.005% | 0.005% | 0.003% | 0.20% | 0.02% | — | — |
| Preservative[h] | 7.5 ppm | 7.5 ppm | 7.5 ppm | 7.5 ppm | 7.5 ppm | — | — | 7.5 ppm | 7.5 ppm |
| Antifoam[i] | 0.011% | 0.011% | 0.011% | 0.011% | 0.011% | — | — | — | — |
| Dye | 22 ppm | 22 ppm | 22 ppm | 22 ppm | 22 ppm | 11 ppm | 11 ppm | — | — |
| Ammonium Chloride | 0.1% | 0.1% | 0.1% | 0.1% | — | — | — | — | — |
| Hydrochloric Acid | 0.012% | 0.012% | 0.012% | 0.0125% | 0.0004% | 0.016% | 0.016% | 0.002% | 0.002% |
| Deionized Water | Balance | Balance | Balance | Balance | Balance | Balance | Balance | Balance | Balance |

[a]N,N-di(tallowoyloxyethyl)-N,N-dimethylammonium chloride.
[b]N,N-di(canola-oyloxyethyl)-N,N-dimethylammonium chloride.
[c]Methyl bis(tallow amidoethyl)2-hydroxyethyl ammonium methyl sulfate.
[d]Cationic starch based on common maize starch or potato starch, containing 25% to 95% amylose and a degree of substitution of from 0.02 to 0.09, and having a viscosity measured as Water Fluidity having a value from 50 to 84.
[e]2,2,4-trimethyl-1,3-pentanediol.
[f]Copolymer of ethylene oxide and terephthalate having the formula described in U.S. Pat. No. 5,574,179 at col.15, lines 1–5, wherein each X is methyl, each n is 40, u is 4, each $R^1$ is essentially 1,4-phenylene moieties, each $R^2$ is essentially ethylene, 1,2-propylene moieties, or mixtures thereof.
[g]Diethylenetriaminepentaacetic acid.
[h]KATHON ® CG available from Rohm and Haas Co.
[i]Silicone antifoam agent available from Dow Corning Corp. under the trade name DC2310.

The following are non-limiting examples of processes to make the compositions of the present invention.

EXAMPLE X

Cationic Starch Admixed With Fabric Softening Active

To make a composition of the present invention with cationic starch dry powder admixed with the fabric softening active, approximately 25% of the fabric softening raw material containing the active (e.g. N,N-di(tallowoyl-oxyethyl)-N,N-dimethylammonium chloride) and ethanol is premixed with the entire desired amount of cationic starch, such as National 49–3490, then heated to 70–75° C. to fluidize the material. The remaining 75% of the fabric softening raw material is also heated to 70–75° C. to fluidize this portion. The fluidized fabric softening raw material and cationic starch mix is then combined with the remaining fluidized fabric softening raw material. Deionized water, antifoam agent (DC2310), hydrochloric acid, and a preservative (KATHON® CG) are mixed to form a water seat, and this mixture is heated to 70–75° C. The hot mixture of cationic starch and fabric softening active is pumped into the hot water seat. Both mixing and milling are employed to create the fabric softening dispersion. When the necessary amount of fabric softening active has been added to the water seat, the requisite amount of electrolyte (e.g. calcium chloride) is added in while again mixing and milling the product. The product is cooled via a plate and frame heat exchanger to approximately 22° C. The cooled product is mixed using a turbine blade at about 200 rpm, and is finished by adding the requisite amounts of phase stabilizing polymer, perfume, 25% calcium chloride, 10% ammonium chloride, and dye. Other adjunct ingredients can be added at this time, if desired.

EXAMPLE XI

Gelatinized Cationic Starch Components Added Into The Water

To make a composition of the present invention with gelatinized cationic starch components added into the water, the cationic starch dry powder is added to the desired amount of deionized water and cooked past the pasting temperature to a polymeric dispersion of the starch components. The remaining amount of deionized water, antifoam agent (DC2310), hydrochloric acid, and a preservative (KATHON® CG) are mixed to form a water seat, and this mixture is heated to 70–75° C. The starch component dispersion, which is kept hot following gelatinization, is added to the heated water seat. A fabric softening raw material containing the active (e.g. N,N-di(tallowoyl-oxyethyl)-N,N-dimethylammonium chloride) and ethanol is heated to 70–75° C. to fluidize the material. When the fabric softening active is fluidized, it is pumped into the hot water seat which contains the cationic starch components. Both mixing and milling are employed to create the fabric softening dispersion. When the necessary amount of fabric softening active has been added to the water seat, the requisite amount of electrolyte (e.g. calcium chloride) is added in while again mixing and milling the product. The product is cooled via a plate and frame heat exchanger to approximately 22° C. The cooled product is mixed using a turbine blade at about 200 rpm, and is finished by adding the requisite amounts of soil release agent, perfume, 25% calcium chloride, 10% ammonium chloride, and dye. Other adjunct ingredients can be added at this time, if desired.

EXAMPLE XII

To make a spray-on composition of the present invention, the cationic starch dry powder is added to the desired amount of deionized water and cooked past the pasting temperature to a polymeric dispersion of the starch components. The remaining amount of deionized water and hydrochloric acid are mixed to form a water seat, and this mixture is heated to 70–75° C. The starch component dispersion, which is kept hot following gelatinization, is added to the heated water seat. A fabric softening raw material containing the active (e.g. N,N-di(tallowoyl-oxyethyl)-N,N-dimethylammonium chloride) and ethanol is heated to 70–75° C. to fluidize the material. When the fabric softening active is fluidized, it is pumped into the hot water seat which contains the cationic starch components. Both mixing and milling are employed to create the fabric softening dispersion. The product is cooled via a plate and frame heat exchanger to approximately 22° C. The cooled product is mixed using a turbine blade at about 200 rpm, and is finished by adding the requisite amounts of perfume and preservative (KATHON® CG). Other adjunct ingredients can be added at this time, if desired.

EXAMPLE XIII

A first mixture and a second mixture are prepared and then combined to form a composition of the present invention. For the first mixture, the cationic starch dry powder is added to the desired amount of deionized water and cooked past the pasting temperature to a polymeric dispersion of the starch components.

In a separate 250 mL beaker, the second mixture is prepared by sequentially adding the following ingredients with 2 minutes of stirring time on a magnetic stir plate in between addition of each ingredient: deionized water, $MgCl_2$, HCl, DTPA, Pluronic L35, 2,2,4-trimethyl-1,3-pentanediol, Varisoft® 222 LM, Adogen CDMC, perfume, Neodol 91-8, Liquitint Blue ED. The final composition is prepared by adding first mixture to the second mixture and stirring for 10 minutes on a magnetic stir plate.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric softening composition comprising: a fabric softening active; and a cationic starch; wherein the cationic starch comprises a weight average molecular weight range of from about 2,000,000 to about 10,000,000 Daltons; wherein the cationic starch is chemically modified to provide the starch with a net positive charge; and wherein the composition comprises a viscosity of less than about 2000 centipoise;

wherein the cationic starch comprises from about 2% to about 7% of the fabric softening composition; and wherein the fabric softening active comprises an ester guaternary ammonium comprising compound.

2. The composition of claim 1, wherein said composition comprises a viscosity less than about 500 centipoise; and wherein the fabric softening compound comprises a quaternary ammonium compound.

3. The composition of claim 2, wherein said viscosity comprises less than about 200 centipoise; wherein the cationic starch comprises from about 1% to about 7% by weight of the composition.

4. The composition of claim 1, wherein said composition comprises at least about 2%, by weight of said composition, of said fabric softening active; and wherein the cationic starch comprises from about 2% to about 7% by weight of the composition.

5. The fabric care composition of claim 1, wherein said composition comprises from 2% to about 7%, by weight of said composition, of said cationic starch.

6. The fabric care composition of claim 5, wherein said composition comprises at least about 10% by weight of the ester quaternary ammonium comprising compound.

7. The fabric care composition of claim 1, wherein said cationic starch has an amylose content of from about 0% to about 70%, by weight of said cationic starch.

8. The fabric care composition of claim 7, wherein said cationic starch has an amylose content of from about 15% to about 50%, by weight of said cationic starch.

9. The fabric care composition of claim 8, wherein said cationic starch has an amylose content of from about 25% to about 30%, by weight of said cationic starch.

10. The fabric care composition of claim 1, wherein said cationic starch comprises the weight average molecular weight of from about 50,000 to about 7,000,000 Daltons.

11. The fabric care composition of claim 10, wherein said cationic starch the weight average molecular weight of from about 150,000 to about 7,000,000 Daltons.

12. The fabric care composition of claim 1, wherein said cationic starch is cationic maize starch.

13. The fabric care composition of claim 1, wherein said cationic starch is partially gelatinized cationic starch.

14. A method of softening a fabric comprising the step of contacting said fabric with a composition according to claim 1.

* * * * *